US005483765A

United States Patent [19]

Karsten et al.

[11] Patent Number: 5,483,765

[45] Date of Patent: Jan. 16, 1996

[54] DEVICE FOR DISPLAYING PICTURES IN SEQUENCE

[75] Inventors: Robert A. Karsten, Fox Point; Jon P. Strawbridge, Glendale, both of Wis.

[73] Assignee: Everbrite, Inc., Greenfield, Wis.

[21] Appl. No.: 228,726

[22] Filed: Apr. 18, 1994

[51] Int. Cl.[6] ..... G09F 11/02

[52] U.S. Cl. ..... 40/505; 40/502

[58] Field of Search ..... 362/282, 812; 40/502, 503, 504, 505, 506

[56] References Cited

U.S. PATENT DOCUMENTS

| | | | |
|---|---|---|---|
| 1,029,497 | 6/1912 | Goodwin | 40/505 |
| 1,166,515 | 1/1916 | Floessell | 40/505 X |
| 2,779,016 | 1/1957 | Snell | 40/505 X |
| 3,335,513 | 8/1967 | Mann | 40/505 |
| 4,189,859 | 2/1980 | Ahlgren | 40/505 |
| 4,381,616 | 5/1983 | Saxer | 40/502 |
| 5,315,776 | 5/1994 | Strawbridge et al. | 40/505 |

*Primary Examiner*—Kenneth J. Dorner
*Assistant Examiner*—Joanne Silbermann
*Attorney, Agent, or Firm*—Ryan, Maki & Hohenfeldt

[57] ABSTRACT

Rectangular transparency panels form the sides of triangular units that are lighted from within. A gear train drives the units in synchronism. A base housing has a plurality of parallel aligned round posts projecting upwardly from it. The posts have a bore in which the lower end of a tubular lamp resides. Annular recesses around the posts have ring bushings in them. Gears having axially upwardly and downwardly projecting hub portions rotate concentrically to but not directly on the posts. The downwardly projecting hub portion has an annular shoulder that imparts a thrust load to the bushing and the hub extends through the bushing to be journaled for rotation. A gear cover arranged above the posts contains similar bushings that journal the upper hub portions and accept upward thrust load. The upper hub portions of the gears have axial slots. The end caps on which the lower end of the triangular units are slip fitted have hooked deflectable prongs extending from them for sliding into the slots and snapping onto the hub so the gears drive the end caps rotationally. A guide plate having bored pedestals for the upper ends of the tubular lamps to extend through and releasably mounted at a level above the base housing. Upper end caps for the triangular transparency units are journaled for rotation on the pedestals.

9 Claims, 5 Drawing Sheets

DEVICE FOR DISPLAYING PICTURES IN SEQUENCE

BACKGROUND OF THE INVENTION

The invention disclosed herein pertains to a device wherein a plurality of information containing generally rectangular transparency panels are joined at their edges to form equilateral triangular units. Each transparency panel in a unit contains a portion of one of three pictures or scenes. The hollow triangular units are juxtaposed to each other and are adapted for being driven rotationally in synchronism such that when the transparencies that contain components of a particular picture become coplanar, the entire scene or picture becomes visible and intelligible to a viewer. The triangular units each rotate about an elongated light-emitting tube or lamp which illuminates the transparencies from the back to make them visible from the front when they are coplanar.

A sign of this general type is shown in U.S. Pat. No. 4,381,616 and in U.S. patent application Ser. No. 07,957,719, filed Oct. 7, 1992, which is now U.S. Pat. No. 5,315,776, owned by the Assignee of this application.

In display devices of the type outlined above, it is important that when the transparency panels composing a scene are coplanar, the joints between them are minimally visible at close viewing range and are substantially invisible at customary and expected viewing distances. The matter of getting acceptably inconspicuous joints between display panels has been problematical for designers. Of course, minimally visible joints between panels could be achieved if precision metal bearings were used in the rotational structure of the triangular transparency units and, if everything else in the display device were held to close tolerances, but these practices would raise the cost of the devices to an extent that they would not be commercially viable. Even more importantly, it is necessary to have a low cost and low price design that maintains joint invisibility after the display device is used for a long time.

Display devices of the type under consideration are frequently positioned at the point of sale of products, and they may be integrated with a replica of a product or associated with a display of products to which a merchandiser or tavern keeper, for example, would like to attract the attention of customers.

SUMMARY OF THE INVENTION

One achieved objective of the invention is to provide a sequencing image or picture display device that maintains inconspicuous joints between panels after extended use and to do this with relatively low cost but reliable, durable, low maintenance and easy to assemble and disassemble parts.

Another achieved objective is to provide a display device that is distinguished by the ease with which a person of minimal skill can remove existing transparency display units and substitute units so that new scenes can be displayed.

Still another achieved objective is to provide a display device that makes replacement of burned out lamps a simple operation.

According to the invention, the new picture sequencing display device comprises a generally planar base plate. A molded housing is mounted to the base plate to define a chamber above the plate. The top of the housing has a row of vertically extending post members molded integrally and rigidly with it. The number of post members corresponds with the number of triangular transparency display units used in the device. The respective post members have a vertical bore and the axes of the bores lie on a straight line and are parallel. A circuit board interfaces with a vertically downwardly projecting lower end of each post member. The circuit board has a row of equally spaced apart electric contact pads or terminals which are contacted by a spring in the bore by which the lower terminal of a tubular light source or lamp is electrically connected to the pads. A lower ring bushing is mounted in the top of the housing concentric to the post member. A gear element is journaled for rotation on the bushing concentric to the post member. The gear element below the gear teeth is configured to mate with the bushing in such manner that the bushing acts as a thrust bearing and a journal bearing for the gear element so it can be driven rotationally but cannot shift axially or radially. The gear element has an axially extending hub and there is a radially extending shoulder on the hub that serves as a bearing surface. A gear cover is provided to enclose the gear train. The cover has a top or lid in which there are a row of holes to provide for the upper ends of the post members to extend upwardly through the holes. Before the gear case cover is installed, a ring bushing with an axial journal portion and a radially extending thrust load accepting portion is set concentrically on the hub of the gear for the ring bushing to bear on a shoulder on the hub. The upper part of the gear hub is basically circular so it fits without freeplay through the upper ring bushing. The hub has a plurality of axial slots in its periphery. Each slot terminates in junction with a radially inwardly directed hole, so that shoulders or ledges are created at the end of the respective slots. A guide bushing is also fitted on the post member and the annular opening of the hub fits concentrically over the guide bushing to further stabilize the hub end of the gear against radial movement.

The triangularly arranged transparency panels are snugly but releasably fitted on end caps at the upper and lower ends. Each lower end cap has integral prongs projecting downwardly from it. The prongs have hooks formed on their ends. The prongs slide axially of the slots in the gear hub and the hooked ends snap onto the ledges next to the holes at the ends of the slots, so that the ledges hold the hooks and the end caps securely together. The triangular transparency panel units can be exchanged by sliding them manually on or off the triangular lower end caps from the top of the device.

The top region of the display device is provided with a guide plate that has a row of annular bearing pedestals. Each pedestal has a bore through which the upper end of a tubular lamp is guided and extends. The upper triangular end caps that fit into the upper end of the triangular transparency panel units have apertures through which the pedestals extend. Split ring bushings having an annular peripheral groove are installed in the apertures and fit snugly on the pedestals. The split ring bushings serve as journal bearings in which the upper end caps rotate along with the triangular transparency panel units.

A cover is engaged with the top guide plate. The cover has fixed in it a conductive bar or strip. The upper end terminals of the tubular light sources contact the bar which serves as a common electric line for the lamps.

How the foregoing objectives and other more specific objectives and features of the invention are achieved and implemented will be evident in the ensuing more detailed description of a preferred embodiment of the invention which will now be set forth in reference to the accompanying drawings.

DESCRIPTION OF A PREFERRED EMBODIMENT

Figure 1:
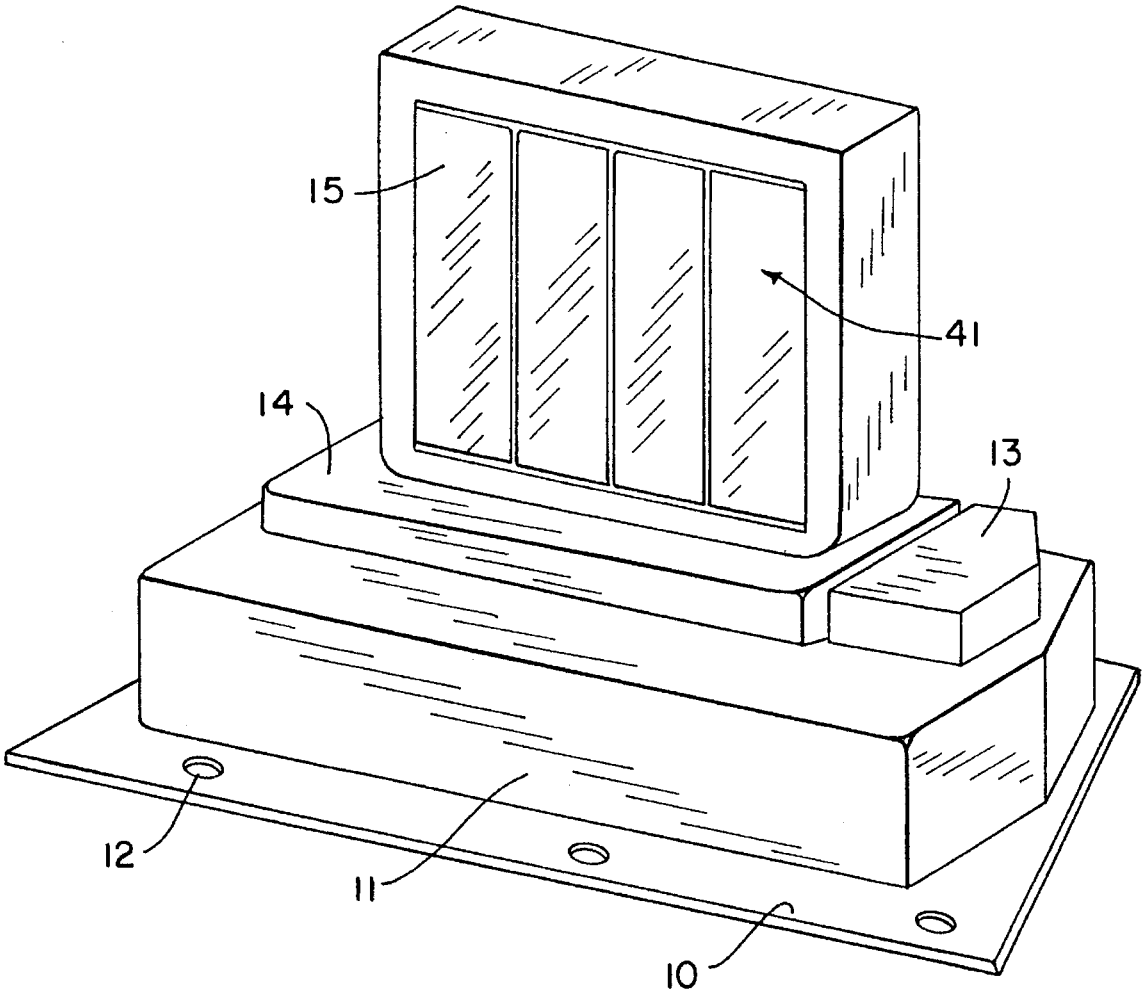
FIG. 1 is a perspective view of the new sequential picture display device.

The display device shown in FIG. 1 comprises a base plate 10 which has holes 12 for fixing it to a surface. A housing 11 is fastened to a base plate. Housing 11 contains electrical components of the device which will be discussed later. The housing is preferably molded of plastic material. Housing 11 has an integrally molded upstanding compartment 13. A gear case or cover 14 is detachably fastened to housing 11. In FIG. 1, four rectangular transparency panels 15 are presently coplanar and, therefore, compose a picture that is intelligible to a viewer. As mentioned earlier, each transparency panel represents one part of a picture or scene. Each of the four transparency panels 15 which are presently visible in FIG. 1, constitute corresponding sides of an equilateral triangle whose other two sides are transparency panels for composing two additional pictures when the triangular units are driven rotationally to coplanar condition. As will be elaborated later, each triangular transparency panel unit has a tubular light source, called a lamp herein, coincident with the rotational axis of the unit for backlighting the transparencies.

Figure 5:
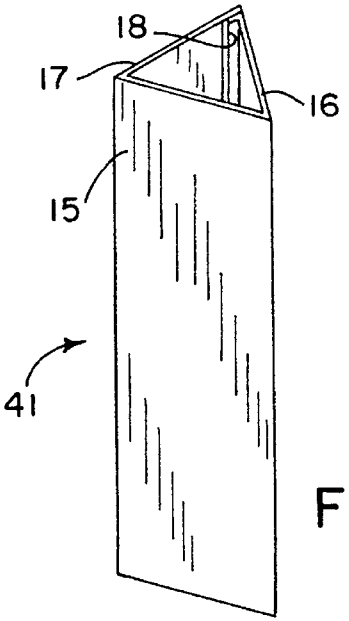
FIG. 5 is a perspective view of one of the triangular transparency units.

FIG. 5 illustrates one of the triangular transparency panel units. It comprises three rectangular transparency panels 15–17 that have been folded into triangular form from a single sheet. One panel 16 has a fold or flap 18 at its edge to provide for adhering it to the inside surface of adjacent panel 17 to create a triangular unit. The panels may be photographic film which provide positive images as viewed from the front of the device or they may be comprised of images screened on film, for example. The transparency panels are about 0.6 mm thick.

Figure 2:
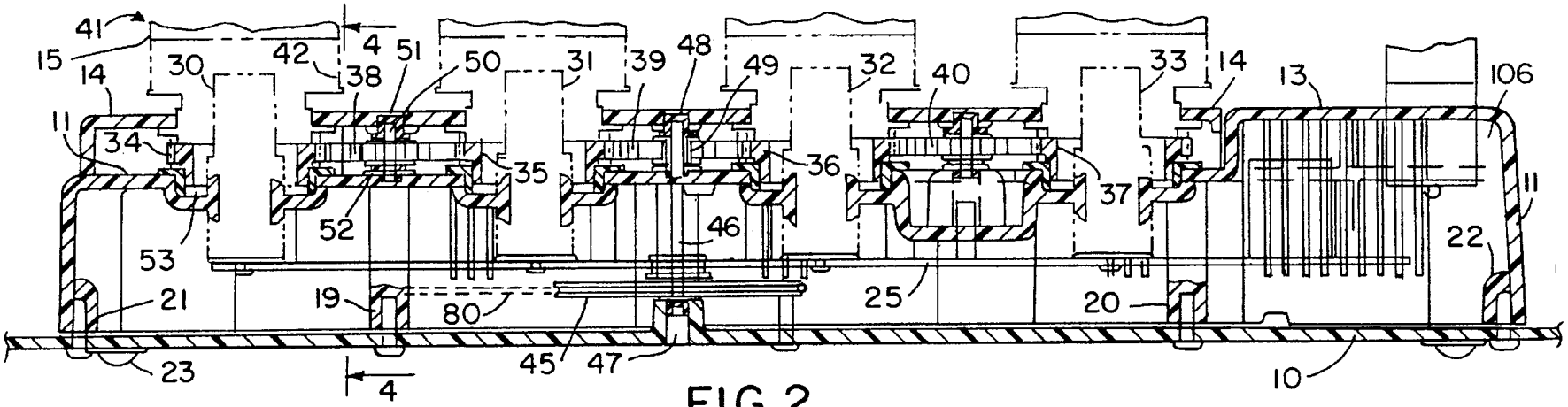
FIG. 2 is a partial vertical sectional view of the lower region of the display device showing the base plate, the base housing, the gear train for driving the transparency panel display units rotationally, the upstanding post members and the lower ends of the display units in phantom lines.
Figure 2A:
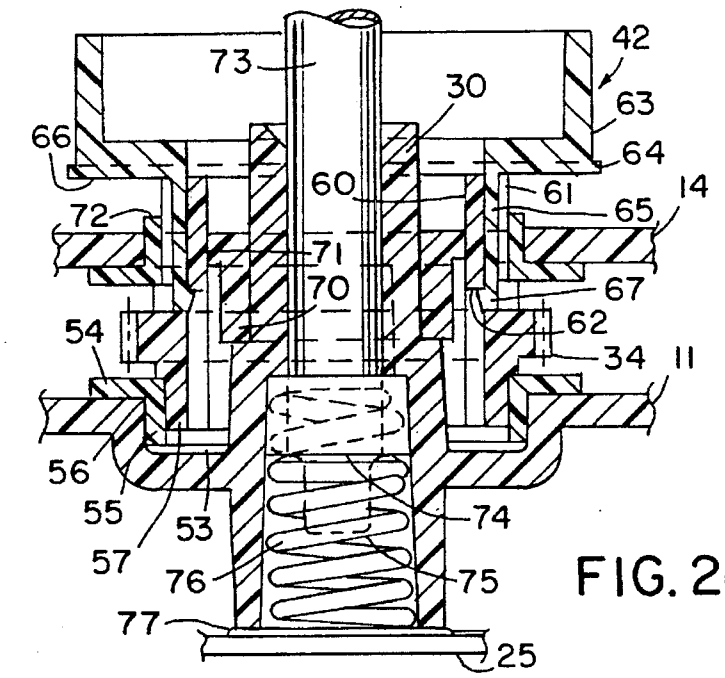
FIG. 2*a* is magnified vertical sectional view of one of the assemblies to which the lower ends of the triangular transparency display units are mounted for rotation about a vertical axis.
Figure 3:
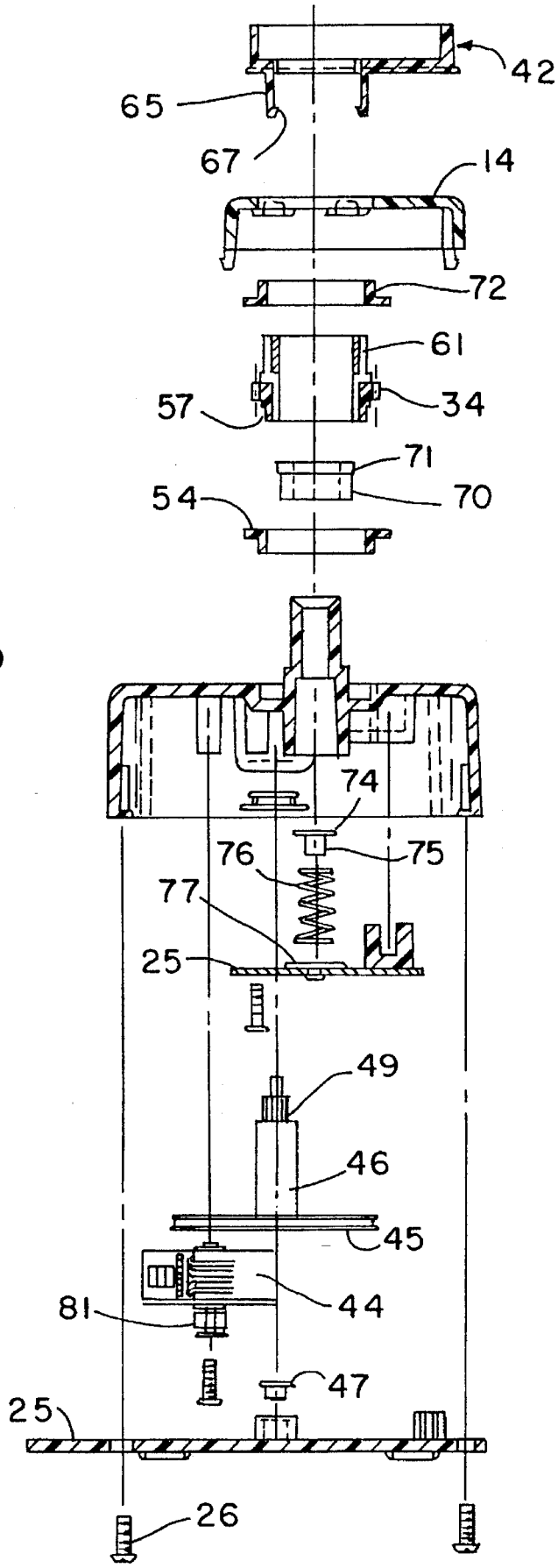
FIG. 3 is an exploded vertical sectional view of the lower region of the display device showing components in detail.

Attention is invited to FIG. 2 which shows the lower or bottom region of the display device in vertical section with some parts represented with phantom lines. Base plate 10, electrical parts housing 11, gear cover 14 and compartment 13 have been previously cited in reference to FIG. 1. Base plate 10 is preferably composed of a plastic material. Electrical housing 11 and gear case or cover 14 are preferably molded of a rigid plastic material that is opaque. Housing 11 has internal columns such as those marked 19 and 20 and molded pads 21 and 22 into which screws are turned to hold the base plate 10 to the open bottom of electrical housing 11. A plurality of elastic bumpers 23 are fastened to base plate 10 to prevent the plate from bearing directly on a supporting surface. A circuit board 25 is mounted within housing 11 by means of screws 26 which do not appear in FIG. 2 but are shown in FIG. 3. The top surface of housing 11 in FIG. 2 is configured to include a row of four parallel and aligned post members 30, 31, 32 and 33 which are represented by phantom lines. A typical post member 30 and affiliated parts is shown realistically and magnified in FIG. 2*a* which will be discussed in detail shortly hereinafter. Each post member 30, 31, 32 and 33 has a spur gear 34, 35, 36 and 37 journaled on it for rotation by means which will be described in detail when FIG. 2*a* is discussed. In FIG. 2, idler gears 38, 39 and 40 mesh with spur gears 34–37. As shown in FIG. 2, the triangular rotatable display units are generally designated by the numeral 41 as they are in FIG. 6. The lower end of the triangular transparency panel units makes a slip fit with a lower end cap 42 which is represented in phantom lines in FIG. 2. An upper end cap is shown in other views and will be discussed later.

Figure 4:
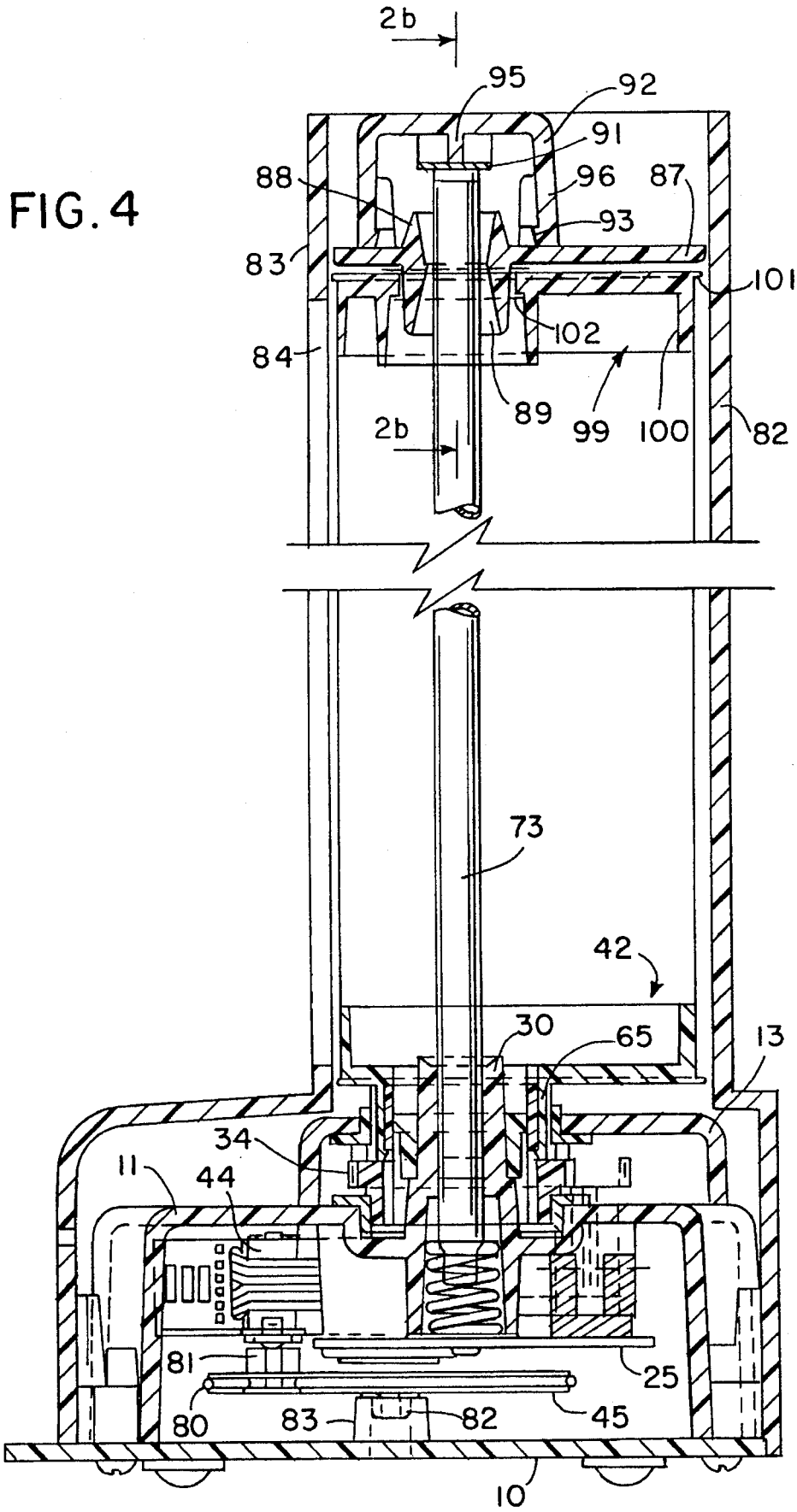
FIG. 4 is a vertical sectional view taken on a line corresponding to 4—4 in FIG. 2.

The gear train in FIG. 2, comprised of the spur gears and idler gears, is driven to effect rotation of the triangular transparency units in unison by a motor 44 which appears in FIGS. 3 and 4. FIG. 2 shows a pulley 45 fixed on a shaft 46. The shaft rotates in a lower bearing 47 and an upper bearing 48. A pinion 49 is fixed to shaft 46. Pinion 49 is meshed with an idler gear which meshes with two spur gears in the gear train. The idler and spur gears are arranged in a manner that assures all display units will rotate in the same direction and in angular synchronism. The round belt 80 that drives pulley 45 is depicted in dashed line in FIG. 2 and is shown in section in FIG. 4.

A typical idler gear 38 is fixed on a shaft 50 which turns in upper and lower bearings 51 and 52, respectively. The upper idler shaft bearings 51 are inserted into suitable recesses in gear cover 14 and the lower bearings 52 are inserted in the top of the electrical component or base housing 11.

The manner in which the triangular transparency display units 41 are mounted for rotation about a vertical axis will be discussed next in reference to FIG. 2*a* to which attention is invited. One of four post members 30 are molded integrally with the top of electrical housing 11 and each post member is centered within an annular recess 53 in the housing top. An annular bushing having a radially extending surface 54 and an axially extending surface 55 is inserted in recess 53. This bushing serves as a journal bearing and a thrust bearing for the gear hub 57 that extends downwardly from the gear itself. Hub 57 has an annular shoulder 56 bearing on the radial bushing surface 54 which accepts the thrust load transmitted through the gear. The hub also has an axially extending surface in which the radial surface of the hub is journaled in bushing surface 55.

Spur gear 34 in FIG. 2*a* also has an axially upwardly extending hub 60 in which there are a plurality of axially extending grooves, such as the one marked 61, that terminate downwardly in a radially inwardly directed opening to thereby define a latching edge or shoulder 62. There are actually three grooves similar to groove 61 in this embodiment. The triangular lower end cap 42 on which the lower end of the triangular transparency unit such as shown in FIG. 6 fits is presently without a transparency unit in FIG. 2*a*. The lower end cap 42 has three triangularly related sides 63 on which the transparency unit fits snugly. An annular ledge or rim 64 on the end cap assures correct vertical positioning of the triangular transparency unit. A plurality of slightly deflectable prongs 65 project integrally from the bottom 66 of lower end cap 42. Prongs 65 have a bevelled hook 67 on their ends. The end cap 42 is latched to gear hub 60 by simply pressing the prongs 65 into the corresponding gear hub grooves 61 until the deflected hooked tips 67 of the prongs snap into engagement with the shoulders 62 on the gear hub. The prongs transmit the rotational force of the gear 34 to the end cap 42 for rotating it and the triangular transparency panel unit that is fitted on the end cap.

FIG. 2*a* illustrates also that there is on the inside of the gear a bushing 70 fitted on post member 30. This bushing has a collar portion 71 whose periphery is an annular bearing surface that fits with close tolerance inside of hub 60 to further stabilize the gear against any inclination to cant due to the driving force applied to the gear.

The external periphery of the upwardly extending hub 60 on gear 34 is also journaled in a bushing that has an axially extending surface 72. One may see that this bushing has a corner that opposes any thrust force which may tend to shift the gear and the transparency display unit thereon upwardly. The arrangement of the bushings and the manner in which the display units are engaged with the gears, precludes any vertical movement of the display units and assures that every picture element at the edges of adjacent coplanar panels will be properly related to each other.

The axial bore in post member 30 in FIG. 2*a* is occupied by the lower end of a tubular lamp 73. The lamp has a thin metal terminal on its end which contacts the annular flange 74 of a cup-shaped eyelet 75. The flange 74 is in electrical contact with a helical spring 76. The spring rests on a conductive strip 77 on circuit board 25 to which voltage is applied for energizing all of the four lamps in this embodiment of the display device. The spring 76 is used to compensate for variations that may occur in the length of lamps of any type and among different types and different manufacturers.

The exploded view in FIG. 3 shows in greater detail some of the parts which were just discussed in reference to FIGS. 2 and 2*a*. The motor 44 for driving the display units rotationally is not shown in FIG. 2 but is shown in FIG. 3 to which attention is now invited. Motor 44 is mounted in electrical housing 11. Motor pulley 81 translates round belt 80 that runs on large grooved pulley 45. As explained in connection with the discussion of FIG. 2, the shaft of pulley 45 has a pinion 49 on it, and the pinion is meshed with the gear train comprised of the spur and idler gears. As shown in FIG. 4, the lower end of the pulley shaft is journaled in a bearing 82 in a boss 83 that is molded integrally with base plate 10. The display assembly thus far discussed is encased in a housing for aesthetic reasons. The housing in FIG. 4 has a rear wall 82 and a front wall 83. The front wall has an open window 84 through which the four coplanar transparency panels composing a scene can be viewed.

The upper structure of the display device will now be described in reference to FIGS. 2*b* and 4 where the end walls of the aesthetic housing are marked 84 and 85. A plastic guide plate, that is generally designated by the numeral 87 spans between end walls 84 and 85. Guide plate 87 has four pedestals, such as the typical one marked 88. Typical pedestal 88 has a biaxially tapered bore 89 through which the upper end of tubular lamp 73 passes. This arrangement assures that the lamps will be held vertical and stable. The upper end of lamp 73 has an electric terminal cap 90 on it. Similar terminal caps on all of the lamps make electric contact with a conductive bar 91 that is in a circuit with the lamp power supply which is not shown. The bar 91 is mounted to the top of plastic cover 92 by means of plastic pins 93 that are molded integrally with cover 92. The pins pass through suitable holes in bar 91 after which the pins are swaged at their ends by melting to form heads 94 that hold the bar 91 to cover 92. There are also some backup pins, such as the one marked 95, that extend integrally from cover 92 and are for preventing the bar 91 from deflecting when it is pressed onto the spring biased lamps 73. A circuit board, not shown, mounted to the cover 92, and having a conductive strip, typical of electronic circuit boards, could be used in place of the bar 91 in FIG. 2*b*. A sectional view of bar 91 and its backup pins 95 is presented in FIG. 4. One may see in FIG. 4, that cover 92 can be latched to guide plate 87 by means of the hooked edges 93 on cover 92 snapping onto lugs 96 that extend upwardly near the ends of guide plate 87.

Figure 2B:
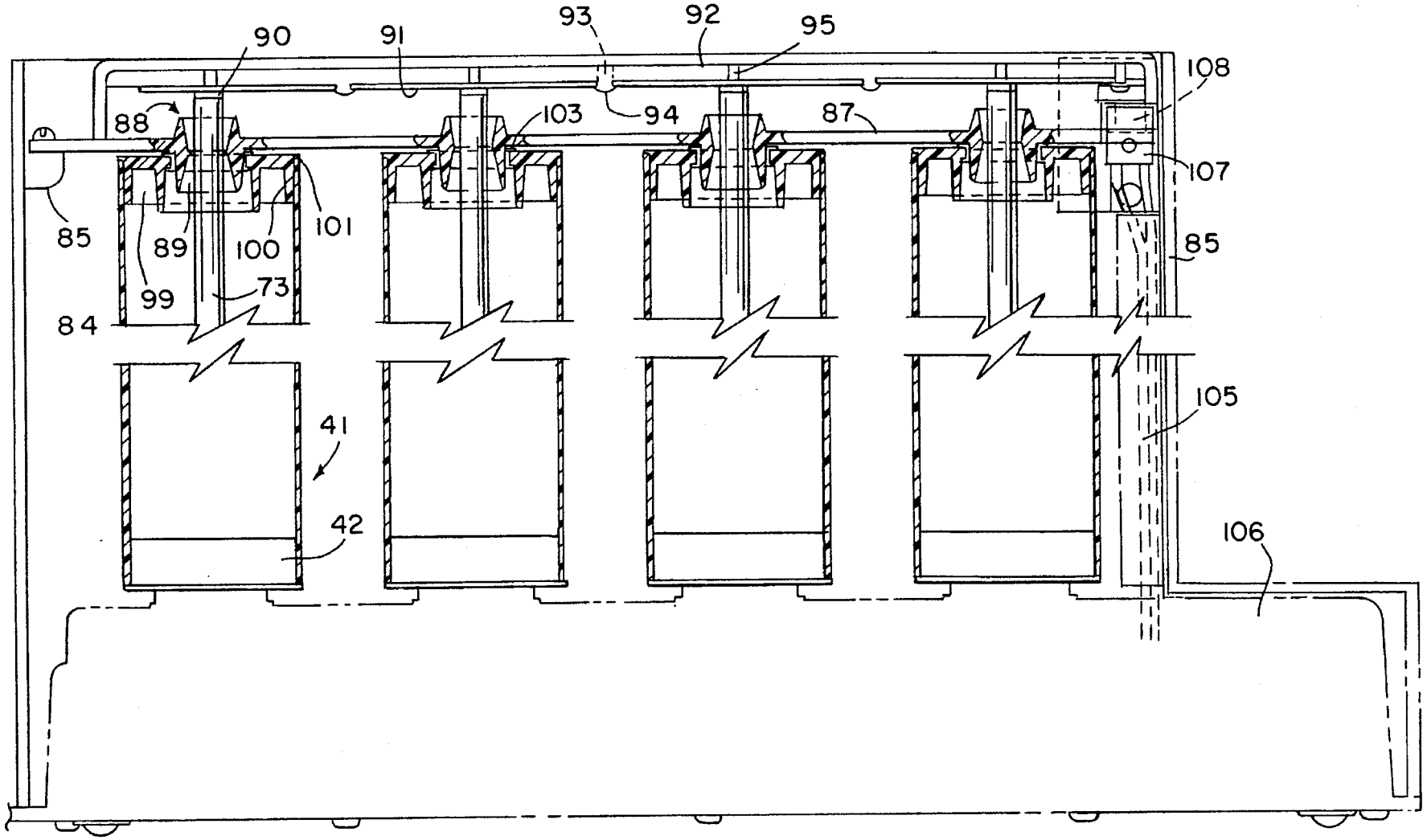
FIG. 2*b* is a vertical section of the upper region of the display device showing how the upper ends of the triangular display units are journaled for rotation.

In FIGS. 2*b* and 4, the triangular transparency units 41 are shown in vertical section and their upper ends are occupied by an upper triangular end cap 99 onto whose triangularly formed side walls 100 the transparency panels 15–17 units fit snugly. The upper end cap walls have rims 101 that limit the distance the caps can slide into the triangular transparency display units 41. The top walls of the end caps have holes in which a split ring bushing 102 is installed. Bushing 102 is a commercially available bushing composed of a resilient plastic material whose periphery has integral radially extending rims, such as the one marked 103, that define an annular groove between them. Bushings 102 have a diagonal slit that permits them to be manually collapsed radially inwardly to reduce their inside diameter so they can be passed into the holes in the upper end caps. After the bushings 102 are released in the holes, they restore to circularity. When this happens, the rims 103 of the bushings overlay the top wall of the triangular end caps and the bushings are thereby retained in the end caps. The bushings are journaled for rotation on the lower part of pedestals 88 when guide plate 87 is placed as shown in FIGS. 2*b* and 4.

It should now be apparent that replacement of a burned out lamp can be done easily by simply lifting cover 92 and guide plate 87 together to access the end of a lamp for withdrawing it. It does not matter that the replacement lamp may be a little longer or shorter than the original lamp because the spring 76 on which the lower end terminal of the lamp is supported always experiences some compression.

Exchange of all triangular transparency panel units 41 to provide a series of three new pictures is an easy operation. When the top cover 92 and guide plates 87 are removed together, the triangular transparency units will remain standing upright and so will the lamps 73 which may be removed, if desired. The end cap 99 is then gripped manually and lifted. Because the fingers squeeze the transparency panels against the sides of the end cap 99, the transparency units will slip off the lower end cap 42 which remains latched to the gear by the prongs extending from the lower end cap 42. The presently installed triangular transparency display units are then slid off upper end caps 99 after which the end caps are pressed onto the new display units. The units can then be slipped onto the retained lower end caps followed by replacing the guide plate 87 and cover 92.

The electric circuitry for the display device has not been discussed in detail since it can be devised by those who have knowledge of simple control circuits. FIG. 2*b* shows some wires 105 that lead up from chamber 106 defined by part 13 of electrical housing 11. The wires terminate in a connector 107 which is in circuit with the lamps. In an actual embodiment, the chamber 106 in the base or electrical housing 11 shown in FIG. 2 is occupied by a controller, not shown, for controlling motor 44. The motor is operated intermittently so the transparency panels remain in coplanar condition long enough for a viewer to be able to comprehend the substance of a picture. After the viewing time interval expires, the motor is started again to rotate the next set of related transparency panels into coplanar condition so another picture is presented for viewing.

We claim:

1. Apparatus for displaying pictures in succession having a row of adjacent display units and means for driving the display units rotationally about parallel axes, the display units including transparency panels in a triangular formation, comprising:

a base and a housing on the base, the housing is configured to define a chamber with the base and has a housing top wall, A row of equally spaced apart post members formed unitarily with said housing top wall, said post members each having a portion projecting upwardly from the top wall, and a portion projecting downwardly from the top wall, a gear element comprising a spur gear having teeth on its periphery, a first hub portion extending axially upwardly from an upper side of the gear element and second hub portion extending axially downwardly from a lower side of the gear element, the gear element and hub portions having an axial bore through which the post member extends for the gear element to be rotatable concentrically to said first hub portion of said post member, said housing top wall has an annular recess surrounding said downwardly extending second hub portion of the gear element and a bushing is installed in the recess, the bushing has a cylindrical opening in which said second hub portion of the gear element is journaled for rotation and said second hub portion has an annular shoulder bearing on said bushing for the bushing to prohibit axially downward shifting of the gear element, a gear cover disposed on said top wall of the housing, and having a top wall spaced from the top wall to define a gear chamber, the top wall of the gear cover having a row of holes coaxial with said post members and a bushing disposed in the holes, respectively, said upwardly extending first hub portion being journaled for rotation in said bushing and said first hub portion having an annular shoulder bearing on the bushing for the bushing to prohibit axially upward movement of the gear element, a lower end cap having a bottom wall in which there is an opening and side walls in triangular formation on which one end of a triangularly formed transparency panels fits, means for attaching the lower end cap to said first upwardly extending hub portion of the gear element, an upper end cap having a top wall in which there is an opening and side walls in triangular formation on which an opposite end of the triangularly formed transparency panel fits, a guide plate having a plurality of equally spaced apart openings and the upper end caps are journaled for rotation coaxially of the openings, said portion of said post members, respectively, projecting downwardly from said top wall providing a lamp socket for accommodating an end portion of a tubular lamp that extends through said upper and lower end caps and the openings in the guide plate.

2. The apparatus according to claim 1 wherein said first hub portion of said gear element has a plurality of axially directed slots providing a shoulder and said means for attaching said lower end cap to said first hub portion includes a plurality of prongs having hooks, the prongs projecting from the lower end cap into said slots for the hooks to latch to said shoulders for coupling said gear element in driving relationship with the lower end cap.

3. Apparatus according to claim 1 wherein said portion of a post member projecting downwardly from said top wall projects into said chamber defined by the housing and a resilient conductive member is disposed in said lamp socket provided by said downwardly projecting portion of the post member, and a nonconductive board member supported below said downwardly projecting portion, and proximate thereto, said board member having an electrical conductor on it and said resilient conductive member in the socket electrically connects the lamp to the conductor.

4. Apparatus according to claim 3 wherein said resilient conductive member is a helical spring.

5. Apparatus according to claim 1 including an element with a cylindrical body and an axial bore fitted directly on the post members, respectively, the body having a collar positioned within a hub portion for bearing in the bore to augment stability of the gear element.

6. Apparatus according to claim 1 including:

an electric motor mounted in said chamber defined by said housing for the base, said motor having a shaft extending through said to top wall of the housing and a pinion is fixed on the shaft, a plurality of idler gears interposed between and meshed with said spur gears on adjacent gear elements, the idler gears having shafts whose opposite ends are journaled in bearings in said top walls of said housing and said gear cover, the pinion meshed with a gear to provide for rotating all of the display units in the same direction and in constant angular relationship.

7. Apparatus according to claim 1 wherein:

said guide plate has a row of equally spaced apart circular pedestals, the pedestals having an axial bore for the lamps to pass through, the upper end cap having a bushing in said opening in its top wall, the bushing retained in the opening and rotatable on the periphery of the pedestal.

8. Apparatus according to claim 7 including:

a cover for said guide plate, the cover having a top wall, an electrical conductor supported from the top wall for being contacted by the lamps.

9. Apparatus according to claim 8 wherein said electrical conductor is a bar having a row of spaced apart holes and plastic studs extend from said top wall of the cover through said respective holes and there are heads on the studs for retaining the bar on the top wall of said cover.

* * * * *